US006658819B2

(12) United States Patent
Gamberini

(10) Patent No.: US 6,658,819 B2
(45) Date of Patent: Dec. 9, 2003

(54) METHOD AND AN APPARATUS FOR PACKAGING STACKS OF MULTIPLY ARTICLES MADE OF PAPER OR THE LIKE

(75) Inventor: Gianluigi Gamberini, Bologna (IT)

(73) Assignee: Techmatic S.r.l. (IT)

( * ) Notice: Subject to any disclaimer, the term of this patent is extended or adjusted under 35 U.S.C. 154(b) by 0 days.

(21) Appl. No.: 10/027,840

(22) Filed: Dec. 19, 2001

(65) Prior Publication Data

US 2002/0073655 A1 Jun. 20, 2002

(30) Foreign Application Priority Data

Dec. 20, 2000 (IT) ..... BO2000A0732

(51) Int. Cl.[7] ..... B65B 63/02; B65B 13/20
(52) U.S. Cl. ..... 53/436; 53/439; 53/466
(58) Field of Search ..... 53/438, 439, 436, 53/466, 465, 526, 528, 529, 530, 228

(56) References Cited

U.S. PATENT DOCUMENTS

| | | | | | |
|---|---|---|---|---|---|
| 3,324,624 | A | * | 6/1967 | Mayer | 53/230 |
| 3,585,777 | A | * | 6/1971 | Pesch | 53/397 |
| 3,968,619 | A | * | 7/1976 | Fishburne | 53/399 |
| 3,996,728 | A | | 12/1976 | Gentili | |
| 4,006,576 | A | * | 2/1977 | Tetenborg | 53/527 |
| 4,738,078 | A | * | 4/1988 | Benz et al. | 53/439 |
| 4,875,328 | A | * | 10/1989 | Meyer | 53/529 |
| 4,953,344 | A | * | 9/1990 | Wallace | 53/528 |
| 5,125,210 | A | * | 6/1992 | Lang et al. | 53/399 |
| 5,133,173 | A | * | 7/1992 | Draghetti et al. | 53/466 |
| 5,189,864 | A | * | 3/1993 | Cinotti et al. | 53/439 |
| 6,021,890 | A | * | 2/2000 | Focke et al. | 206/83.5 |
| 6,223,500 | B1 | * | 5/2001 | Kramps | 53/399 |
| 6,318,053 | B1 | * | 11/2001 | Frank et al. | 53/586 |

FOREIGN PATENT DOCUMENTS

| | | |
|---|---|---|
| FR | 2771375 A1 | 5/1999 |
| GB | 1023990 | 3/1966 |
| WO | WO 97 41033 A | 11/1997 |

* cited by examiner

*Primary Examiner*—Rinaldi I. Rada
*Assistant Examiner*—Paul Durand
(74) *Attorney, Agent, or Firm*—William J. Sapone; Coleman Sudol Sapone, P.C.

(57) ABSTRACT

According to a method for packaging one stack of multiply articles made of paper, a presser receives and compacts the stack of articles to be packaged and a pusher moves longitudinally the stack so as to make the stack hit a wrapping foil, previously placed vertically. The stack, partially wrapped within the wrapping foil, is introduced between a pair of belt conveyors. The presser and the pusher are carried by a slide moving longitudinally between a backward position with respect to the wrapping foil, where the stack is received and compacted, and a forward position, in which the presser hit the wrapping foil and move close to the belt conveyors, so as to transfer and introduce the stack between the belt conveyors.

3 Claims, 2 Drawing Sheets

FIG. 3
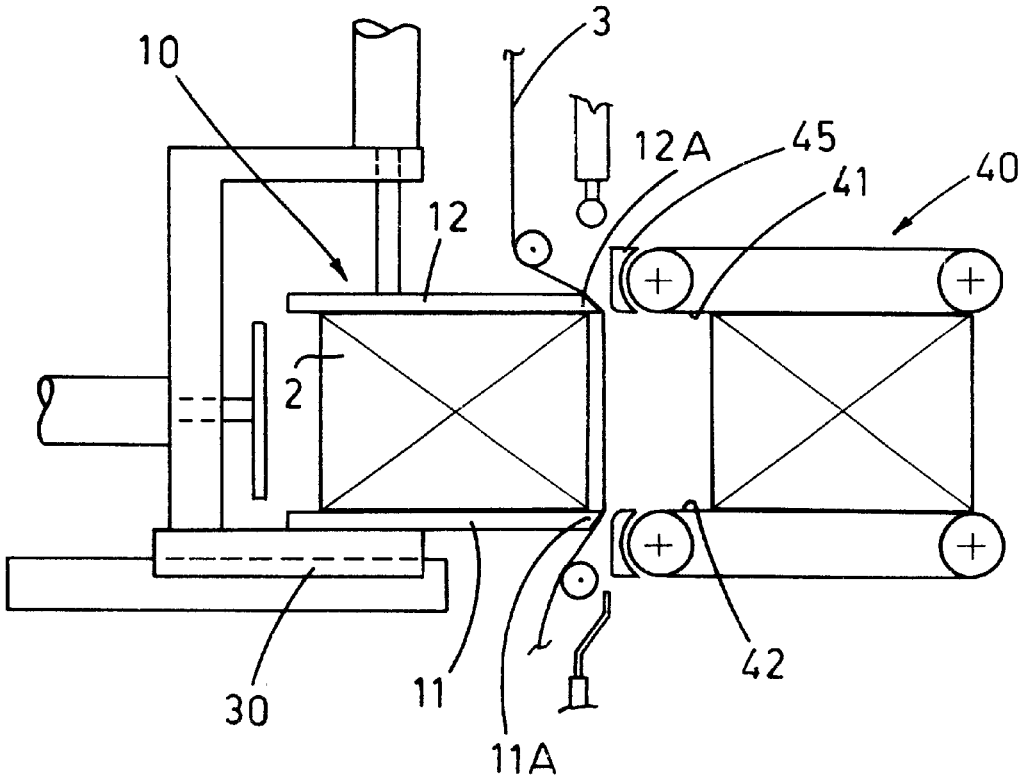
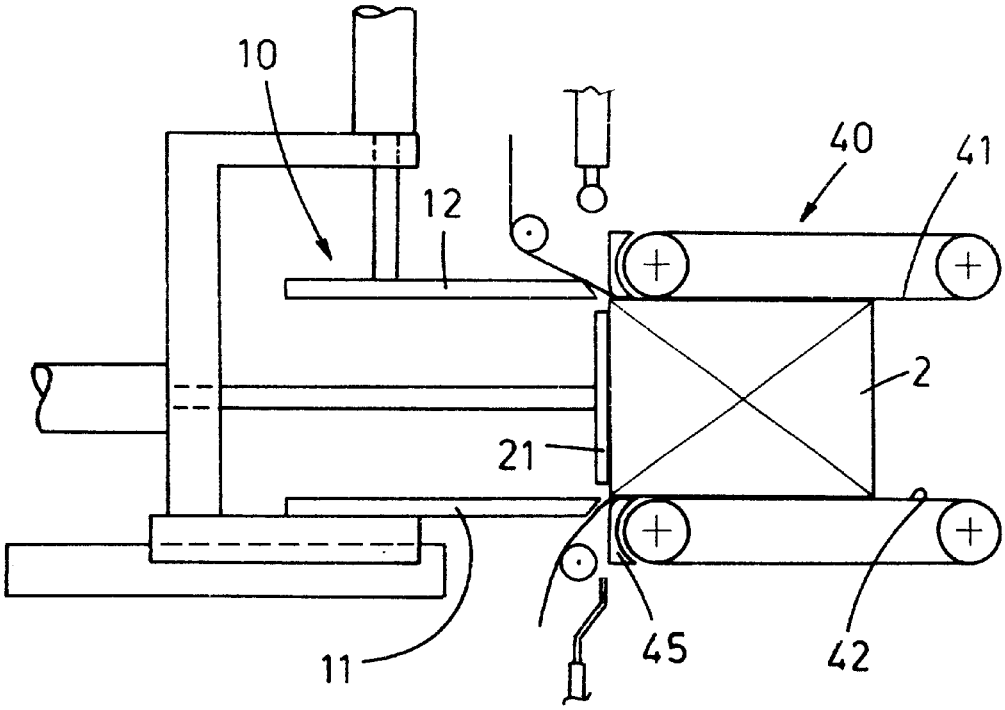
FIG. 4

METHOD AND AN APPARATUS FOR PACKAGING STACKS OF MULTIPLY ARTICLES MADE OF PAPER OR THE LIKE

TECHNICAL FIELD

The present invention relates to packaging of stacks of multiply articles made of paper or the like, in particular a stack of folded napkins made of tissue paper material.

DESCRIPTION OF THE PRIOR ART

Nowadays, there are machines which package automatically stacks of multiply articles made from paper or like material. The above mentioned machines feed the stacks of multiply articles to a conveying line, which space them out and conveys them, stepwise, to a packaging device. The packaging device is operatively connected to a feeding line which feeds sheets for wrapping the stacks.

More precisely, the packaging devices include means for:

compacting the stack to be packaged, conveying longitudinally the stack, so that it hits a relative packaging sheet, previously placed and held vertically by means connected to the above mentioned feeding line, until the stack, wrapped within the packaging sheet along three subsequent sides of its contour, is introduced between facing runs of a pair of endless conveying means, welding the overlapped edges of the wrapping sheet in the region of the fourth side of the stack contour.

Folding means, situated downstream of the above mentioned device, fold the wrapping sheet over the front and rear heads of the stack.

Then, traditional welding means weld the flaps made by the folding means.

According to a known solution, the means for compressing the stack to be packaged include a base plate, onto which the stack is fed, and an upper pressing plate, which is movable vertically to compact the stack.

The base plate and the upper pressing plate are situated close to the wrapping sheet which is fed vertically.

Actually, the base plate includes a portion, which is movable between a position slightly backward with respect to the vertical plane on which the wrapping sheet is fed, and a forward position close to the sheet.

The conveying means include also a pair of platens moving longitudinally and receiving the stacks to be transferred to the conveying means.

The stack to be packaged, fed onto the base plate, is pressed by the upper pressing plate and subsequently, acted on by a conventional pusher member, which transfers it longitudinally, so as to hit the packaging foil, previously situated vertically.

In suitable time relation, the movable platens, with the previously fed stack still situated therebetween, are moved to a backward position, close to the wrapping foil, so as to receive the forward moving stack, which thus hits the wrapping foil.

Obviously, the distance between the movable platens is equal to the distance between the base plate and the upper pressing plate which compact the stack.

Due to the forward movement, the stack, which hits the wrapping foil, is inserted between the movable platens and, at the same time, moves the previous stack toward the conveying means.

Then, the movable platens are moved to a forward position, so that means for folding and welding the overlapped edges of the wrapping foil can be operated.

According to another known solution, the stack, which hits the wrapping foil, is introduced between a pair of auxiliary conveying members situated close to the wrapping foil, suitably distant therefrom.

The auxiliary conveying members are in line with the conveying means situated downstream, and distant therefrom by a section which allows to introduce the means for folding and welding the overlapped edges of the wrapping foil.

In this case, the stack to be packaged, fed onto the base plate, is compacted by an overlaying pressing plate and then transferred longitudinally by a pusher element, so as to hit a wrapping foil and to be introduced between the auxiliary conveying means, which transfers the partially wrapped stack to the conveying means, situated downstream.

Actually, the operation speed of the above described devices does not satisfy different needs, due to the complexity of the movements.

Moreover, especially in the second of the described solutions, the wrapping foil is not tightened perfectly, which results in not perfectly square packages.

Further, the above described devices are complex in their construction and are poorly functional, which derives particularly from the use of the auxiliary means for introducing stacks into the conveying means.

Consequently, the costs increases and so does the probability of irregular operation.

SUMMARY OF THE INVENTION

The object of the present invention is to propose a method which allows to package stacks of multiply articles, with a high operation speed, maintaining at the same time perfect tensioning of the wrapping foil.

Another object of the present invention is to propose a method which minimizes the inoperative periods and reduces the stroke necessary to transfer the stack from the pressing means to the pair of conveying means.

A further object of the present invention is to propose a device which allows to package stacks of multiply articles, with a high operation speed, maintaining at the same time perfect tensioning of the wrapping foil.

A still further object of the present invention is to propose a device which carries out the above packaging by a very simple and functional structure.

The above mentioned objects are obtained in accordance with the contents of the claims.

BRIEF DESCRIPTION OF THE DRAWINGS

The characteristic features of the present invention will be pointed out in the following description of a preferred, but not unique embodiment, with reference to the enclosed drawings, in which:

FIGS. 2, 3 and 4 are front views of the device in subsequent working steps of the working cycle, during which one stack of articles is packaged.

DETAILED DESCRIPTION OF THE PREFERRED EMBODIMENTS

Figure 1:
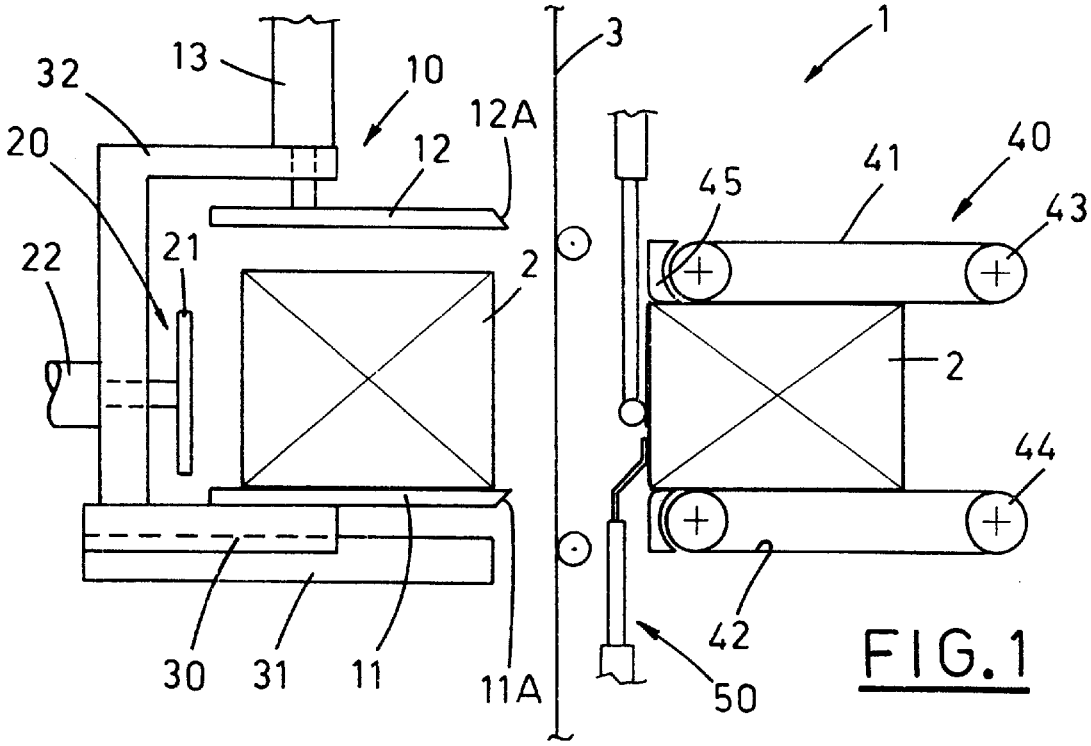
FIG. 1 is a front schematic view of the device for packaging a stack of multiply articles, working according to the proposed method.

With reference to the above figures, reference numeral 1 indicates a device for packaging a stack 2 of multiply paper articles or the like, e.g. folded napkins made of tissue material, according to the present invention method.

The device 1 includes means 10 for receiving and compacting the stack 2 to be packaged, including substantially a base plate 11, onto which the stack 2 is fed, and an upper pressing plate 12, operated by an actuator 13 so as to move vertically to compact the stack 2.

The means 10 for receiving and compacting the stack 2 to be packaged cooperate with means 20 for conveying longitudinally the stack 2.

The conveying means 20 include basically a pusher element 21, which is operated with reciprocating motion by an actuator 22.

The means 10 for receiving and compacting the stack 2 and the means 20 for transferring longitudinally the stack 2, are supported by a slide 30, moving longitudinally on suitable guide means 31.

More precisely, the base plate 11 is fastened directly to the slide 30, while the upper pressing plate 12 is carried by a framework 32 extending from the slide 30 and carrying also the pusher element 21.

The slide 30 is operated, by known actuators, which are not shown, so as to move between a backward position with respect to the vertical plane of a wrapping foil 3, which is fed in time relation with receiving and compacting the stack 2 by the means 10, and a forward position, in which the means 10 for receiving and compacting the stack 2 hit the wrapping foil 3.

A pair of conveying means 40 is situated downstream of the means 10 for receiving and compacting the stack 2, on the side opposite to the above mentioned vertical plane of the wrapping foil 3.

The stack 2, partially wrapped with the foil 3, is introduced between the conveying means 40, which include belt conveyors 41, 42 mounted around relative wheels 43, 44 and with their runs facing each other, between which the stack 2 is introduced.

The conveying means 40 are operated in time relation with operation of the transferring means 20, whose peripheral speed is equal to the peripheral speed of the conveying means 40.

The conveying means 40 face, on their side turned toward the wrapping foil 3, shaped profiles 45 which have tapered section to facilitate introduction of the stack 2 between the belt conveyors 41, 42.

The device includes also known means 50 for folding and welding the overlapped edges of the wrapping foil 3, situated directly upstream of the second conveying means 40 and substantially flush with the opening of the belt conveyors 41, 42.

In time relation with the introduction of the stack 2, partially wrapped with the foil 3 along three consequent sides, between the belt conveyors 41, 42, the folding means 50 fold the opposite edges of the foil 3 and weld them in the region of the fourth side of the longitudinal contour of the stack.

The proposed method and the device will be described now, beginning from feeding a stack 2 of multiply articles to the base plate 11 of the pressing means 10, shown in FIG. 1.

A relative wrapping foil 3 is positioned vertically, in time relation with the receiving and compacting of the stack 2 by the pressing means 10.

Figure 2:
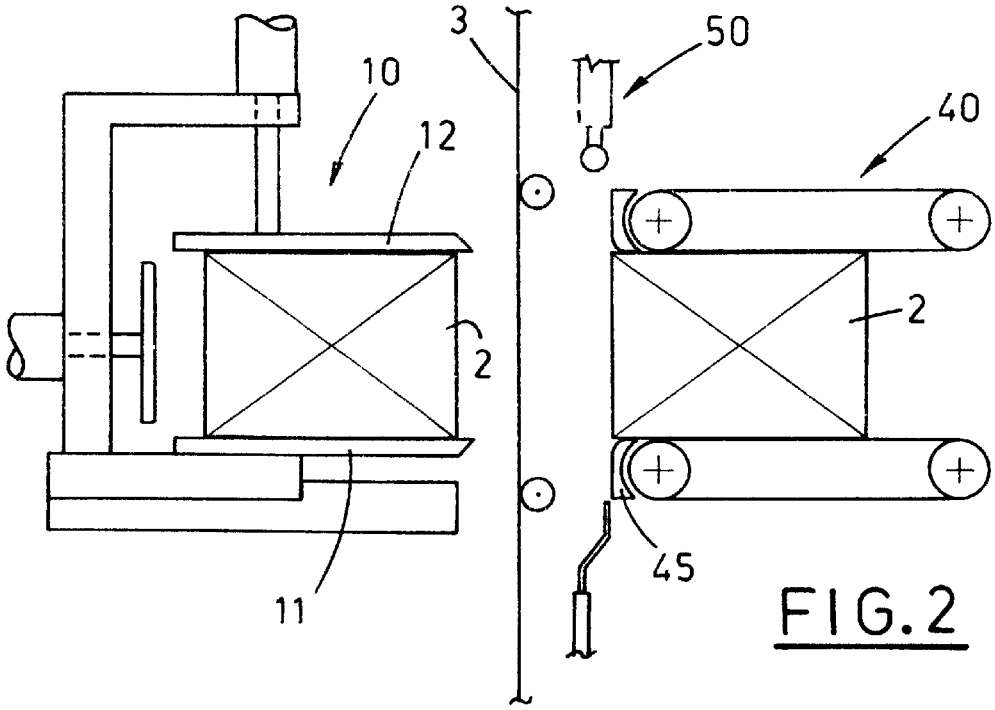

The stack 2 is compacted by downward movement of the upper pressing plate 12, which presses the stack 2 onto the base plate 11 (FIG. 2).

Obviously, the distance between the plates 11 and 12, while in the stack 2 compacting position, is equal to the distance of the opposite runs of the belt conveyors 41, 42 of the conveying means 40.

Then, the slide 30, carrying the pressing means 10 and the transferring means 20 is moved forward from the initial position, backward with respect to the wrapping foil 3 plane, to a forward position, in which the pressing means 10 hit the foil 3 (FIG. 3).

In particular, the forward movement of the slide 30 brings a front edge 11A, 12A of the plates 11, 12 of the pressing means 10 close to the shaped profiles 45, which face the belt conveyors 41, 42 of the conveying means 40.

The front edges 11A, 12A of the plates 11, 12 are suitably tapered.

Then, the pusher element 21 is operated to transfer the stack 2, partially wrapped with the foil 3, between the opposite runs of the belt conveyors 41, 42 of the conveying means 40 (FIG. 4).

The stack 2 is wrapped with the wrapping foil 3 along three subsequent sides of the stack longitudinal contour.

The shaped profiles 45 act as tapered guide for the introduction of the stack 2 and the foil 3 between the above mentioned opposite runs of the belt conveyors 41, 42.

At this point, the pressing means 10 and the conveying means 20 are brought back to the initial position, and simultaneously, the slide 30 returns to its backward position, so as to prepare the device for feeding a next stack of multiply articles to be packaged.

During the feeding step, the means 50 are operated to fold and weld the overlapped edges of the wrapping foil 3 (see again FIG. 1).

The means 50 act substantially in a position flush with the shaped profiles 45.

Therefore, the packaging method according to the present invention fulfills the object of packaging multiply articles with high operation speed due to the reduction of the inoperative times, maintaining at the same time perfect tensioning of the wrapping foil and perfect squaring of the packaged stack.

Actually, the wrapping foil 3 is stretched by forwarding of the pressing means 10, carried by the slide 30, up to the shaped profiles 45, which act as tapered guide for the introduction of the stack 2 between the belt conveyors 41, 42 of the conveying means 40.

Then, the stack 2 is introduced directly between the belt conveyors 41, 42, thus drawing the foil 3 between the conveying belts 41, 42.

Practically, during the transfer, there are no empty spaces, which could cause undesired loosening of the wrapping foil.

Consequently, the so obtained packages are well compressed in a square form.

Moreover, it is to be pointed out that the wrapping foil 3 does not resist due to friction during the introduction between the belt conveyors 41, 42.

The foil 3 can be advantageously fed, at least in correspondence to the upper run, with the speed equal to the peripheral speed of the belt conveyors 41, 42.

The proposed device, carrying out the above described method, is obtained by a simple and functional structure; actually, it does not require any auxiliary means for helping the introduction of the stacks between the conveying belts of the conveying means, as it occurs in traditional solutions.

Therefore, the packaging of the multiply paper articles or the like, such as e.g. folded napkins made of tissue material, is obtained at proportionally reduced costs.

The illustrated example takes into consideration only one stack; it is understood that two or more stacks can be placed on the plate 11, to be acted on by first the pressing plate 12 and then the pusher element 21; obviously, the dimensions of the foil 3 will be sufficient to wrap the whole pack.

What is claimed is:

1. A method for packaging at least one stack of compactable multiply articles comprising the steps of:

a) feeding the at least one stack of multiply articles between pressing means having an upper member and a lower member, compacting the stack between the upper member and the lower member of said pressing means, to a height equal to a distance between facing conveying means including belt conveyors situated downstream of said pressing means;

b) longitudinally moving said stack and said pressing means for engaging a wrapping foil, vertically located between said pressing means and said facing conveying means;

c) longitudinally moving said stack and said pressing means to a forward position close to said facing conveying means, stretching said wrapping foil with said pressing means; and, d) longitudinally transferring and inserting the compacted stack between said facing conveying means, drawing said stretched wrapping foil between said conveying means and around the compacted stack for wrapping three sides of said compacted stack, thereby partially wrapping the stack within said stretched wrapping foil while inserting the compacted stack between said facing conveying means.

2. The method according to claim 1, wherein a speed of said transferring and inserting of said stack between said conveying means is equal to a peripheral speed of said conveying means.

3. The method according to claim 1, further comprising feeding the wrapping foil at least in a region of an upper run of said facing belt conveyors, at a speed equal to a peripheral speed of said belt conveyors.

* * * * *